US005439404A

United States Patent [19]

Sumigawa

[11] Patent Number: 5,439,404

[45] Date of Patent: Aug. 8, 1995

[54] COOLING SYSTEM FOR OUTBOARD MOTOR

[75] Inventor: Yukio Sumigawa, Hamamatsu, Japan

[73] Assignee: Sanshin Kogyo Kabushiki Kaisha, Hamamatsu, Japan

[21] Appl. No.: 305,200

[22] Filed: Sep. 13, 1994

[30] Foreign Application Priority Data

Sep. 14, 1993 [JP] Japan ..... 5-251032

[51] Int. Cl.[6] ..... B63H 21/10

[52] U.S. Cl. ..... 440/88; 123/196 R

[58] Field of Search ..... 440/88, 89, 900; 123/196 R, 196 AW; 184/6.13, 6.2, 6.18

[56] References Cited

U.S. PATENT DOCUMENTS 3,493,081 2/1970 Tado ..... 440/88

5,232,387 8/1993 Sumigawa ..... 440/89

FOREIGN PATENT DOCUMENTS 1029338 5/1966 United Kingdom ..... 440/88

*Primary Examiner*—Jesus D. Sotelo

*Attorney, Agent, or Firm*—Knobbe, Martens, Olson & Bear

[57] ABSTRACT

A cooling system for an outboard motor and specifically for the lubricating reservoir thereof. The lubricating reservoir depends into the drive shaft housing and is surrounded by an open trough-like water manifold to which cooling water is delivered from the engine. This manifold has lower restricted openings that direct the coolant to the outer peripheral wall of the oil pan of the lubricant reservoir. The water level is maintained by a weir-like structure and the water that overflows the weir is also directed toward the outer surface of the lubricant reservoir.

20 Claims, 8 Drawing Sheets

COOLING SYSTEM FOR OUTBOARD MOTOR

BACKGROUND OF THE INVENTION

This invention relates to a cooling system for an outboard motor and more particularly to an improved arrangement for cooling the lubricating oil supply of an outboard motor.

It has been proposed to provide four cycle engines as the power source for outboard motors. Although four cycle engines have certain advantages over two cycle engines, they are basically more complex and this provides certain design challenges when applied to outboard motors because of the compact nature of such propulsion units. Specifically, if a four cycle engine is to be employed, it is the normal practice to provide a separate lubricant storage reservoir for the lubricant of the engine. An outboard motor presents a particular problem in this area because of the fact that the engine is normally mounted so that its crankshaft rotates about a vertically extending axis. This makes it difficult to employ a wet sump engine as is typical with most applications for four cycle engines.

Thus, dry sump systems are employed and this then presents a problem as to where the lubricant sump is located. If it is positioned beneath the engine in the power head then the engine becomes relatively high and the center of gravity of the outboard motor is elevated to an extent more than desirable. It is not practical to place the oil reservoir in the power head on the sides of the engine due to the desire of maintaining a compact construction, particularly of the power head so that it does not obscure rearward vision.

Therefore, it has been the practice to position the oil reservoir in the drive shaft housing of the outboard motor or at least partially therein. This, however, raises other problems.

In conjunction with most outboard motor practice, the exhaust gases from the engine are discharged downwardly through the drive shaft housing for discharge below the water so that the water in which the watercraft is operating can be employed at least partially for sound deadening. Frequently, it is also the practice to provide an expansion chamber in the drive shaft housing for assisting in silencing the exhaust gas noises. This, however, thus exposes the lubricant reservoir to the heat of the exhaust gases. Therefore, the lubricant for the engine may tend to become overheated due to the inherent operation of the outboard motor. For this reason it has been proposed to provide an arrangement wherein at least some of the cooling water from the engine is drained in proximity to or over the outer periphery of the oil pan so that it may be cooled. An example of a prior art type construction where this is done is shown in FIGS. 1 and 2 with FIG. 1 being a side elevational view of a conventional outboard motor of this type and FIG. 2 as an enlarged cross-sectional view showing how the coolant is delivered to the exterior surface of the oil tank.

An outboard motor constructed in accordance with a conventional practice employing a four cycle engine with a separate lubricant storage system is indicated generally by the reference numeral 11. The outboard motor 11 includes a power head that is comprised of a water cooled four cycle internal combustion engine, indicated generally by the reference numeral 12 and which may comprise any known type. The engine 12 is surrounded by a protective cowling which is comprised of a lower tray portion 13 and an upper, main cowling portion 14. The main cowling portion 14 is detachably connected in a known manner to the tray portion 13.

As is typical with outboard motor practice, the engine 12 is supported on a supporting plate 15 with its output shaft rotating about a vertically extending axis. This output shaft is coupled to a drive shaft 16 that depends into a drive shaft housing 17 having an outer housing portion 18. The lower end of the drive shaft 16 drives a propeller shaft 19 that is journaled within a lower unit 21 through a bevel gear transmission 22. A propeller 23 is affixed to the propeller shaft 19 in any known manner.

The outboard motor 17 is coupled to a combined clamping swivel bracket assembly, indicated generally by the reference numeral 24 for steering movement of the outboard motor 11 about a vertically extending axis, for tilt and trim movement about a horizontally extending tilt axis and for attachment in a known manner to the transom of an associated watercraft.

The engine 12 is provided with a lubricating system and lubricant is supplied for this system and drained back from it to a lubricant reservoir 25 that is mounted within the drive shaft housing 17 on the underside of the spacer plate 15.

Referring now specifically to FIG. 2, it should be noted that the oil pan 25 has an exterior wall 26 that defines an internal cavity 27 in which the lubricant is contained. The spacer plate 15 is formed with a cooling jacket 28 that is defined by an interior wall 29 and an exterior wall 31. Coolant is delivered from the engine cooling system to this cooling jacket 28. This is done in any known manner.

A gasket 32 is interposed between the drive shaft housing 18, oil pan 25, and the interior of the drive shaft housing 18. A plurality of small weep openings 33 are formed in the gasket 32 around the periphery of the oil pan 26 so that coolant will drain from the jacket 28 and impinge upon the outer walls of the oil pan 26 as shown by the arrows 34 in FIG. 2.

Although this construction has some advantages, there are also certain disadvantages. First, the cooling water is not very equally distributed along the outer periphery of the oil pan 26. In addition, either this cooling water or water which may splash up from the interior of the drive shaft housing 17 can impinge upon the walls 26 and leave deposits which may be corrosive. This is particularly true when operating in a marine environment inasmuch as salt deposits may be formed on the outer surface of the oil pan 25 and specifically its wall 26. Also, the distribution of cooling water around the outer periphery of the wall 26 cannot be ensured. Those weep openings 33 that are disposed closest to the discharge point of water from the engine cooling jacket will receive the most water and other areas will receive little water. Also, when the engine is running at low speeds there will not be a large amount of water flow and hence very little cooling will occur.

It is, therefore, a principle object of this invention to provide an improved oil pan and cooling arrangement for an outboard motor.

It is a further object of this invention to provide an oil pan arrangement for the engine of an outboard motor wherein a copious and uniform supply of water can be supplied over the outer periphery of the oil pan.

SUMMARY OF THE INVENTION

This invention is adapted to be embodied in an outboard motor having a power head that includes an internal combustion engine. A drive shaft depends beneath the power head and contains a propulsion device at its lower end that is driven from the engine. An oil tank for engine lubricant depends at least in part into the drive shaft housing and is substantially surrounded by a trough-like water reservoir that receives water for cooling purposes. A plurality of discharge openings are formed in the lower portion of the water reservoir and drain water around and onto the walls of the oil tank for its cooling.

DETAILED DESCRIPTION OF THE PREFERRED EMBODIMENT OF THE INVENTION

Figure 1:
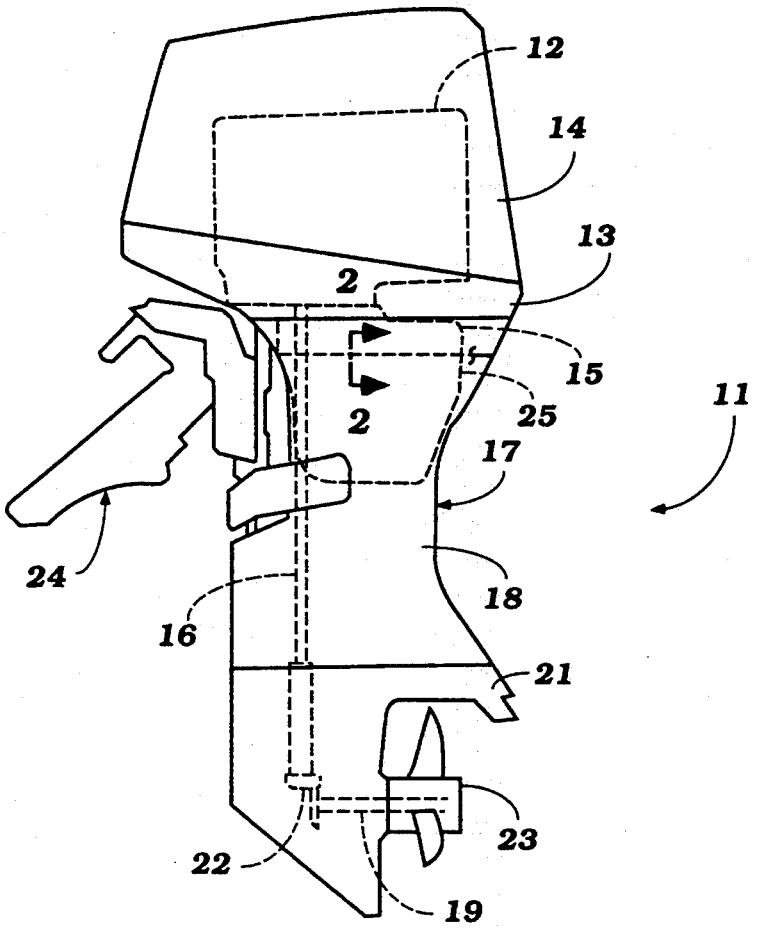
Figure 1 Prior Art
FIG. 1 is a side elevational view of an outboard motor constructed in accordance with a prior art type of arrangement.
Figure 2:
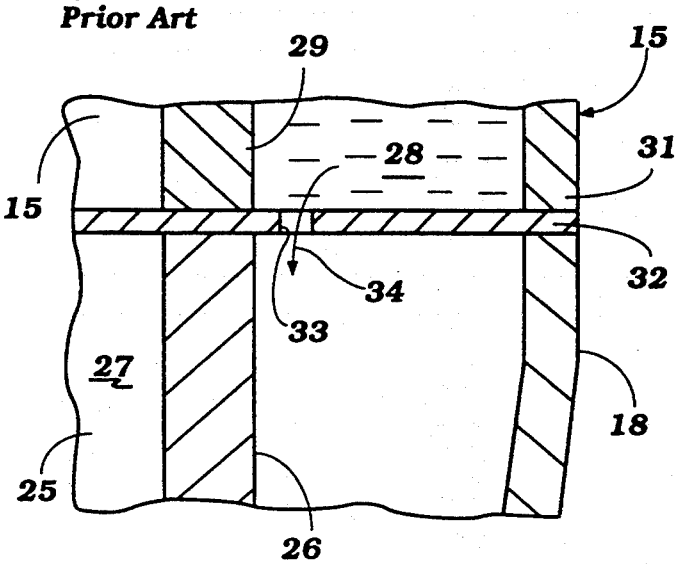
Figure 2 Prior Art
FIG. 2 is an enlarged cross-sectional view taken along the line 2—2 of FIG. 1.
Figure 3:
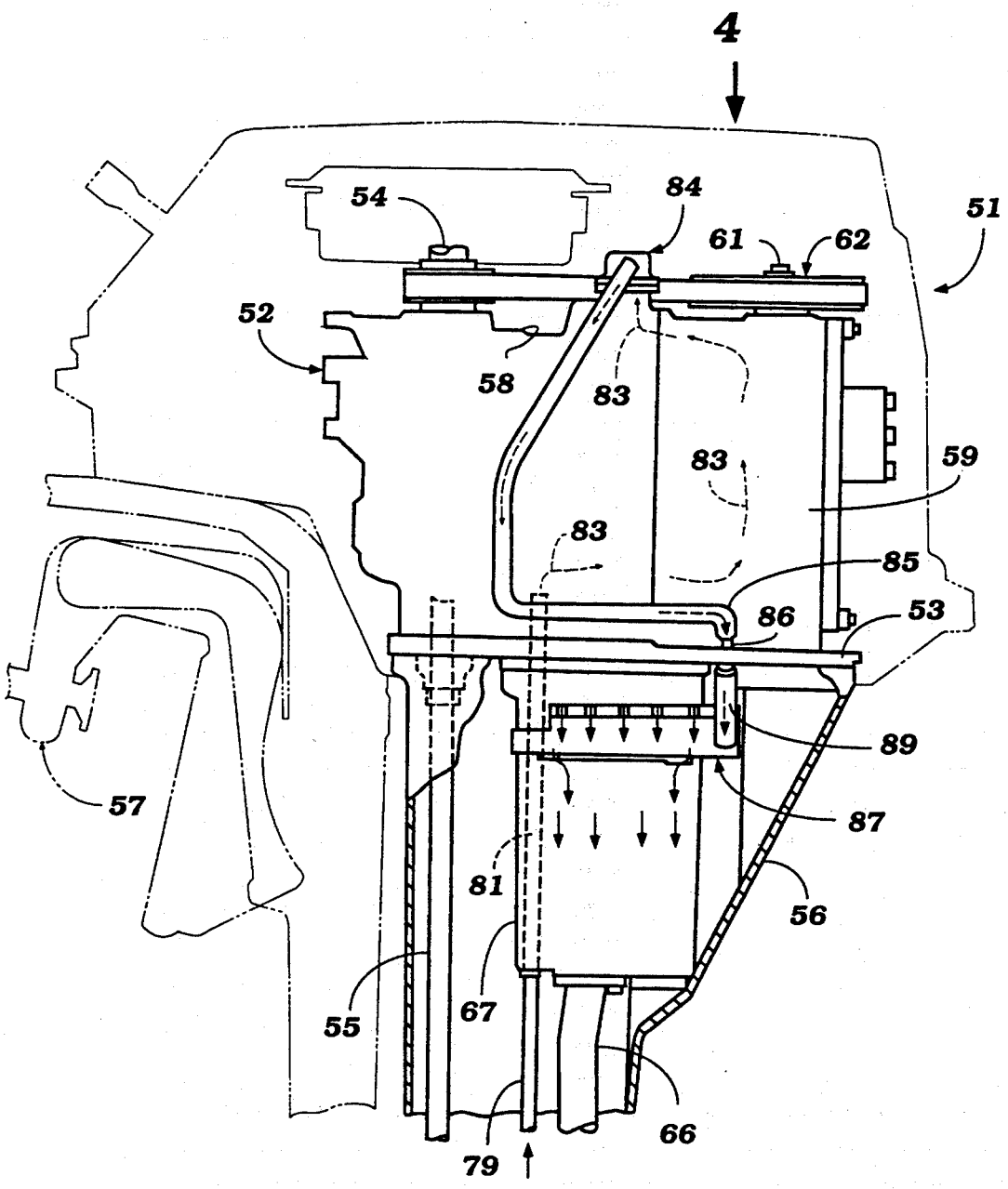
FIG. 3 is an enlarged side elevational view of the upper portion of an outboard motor constructed in accordance with an embodiment of the invention, with components other than the engine shown in phantom so as to more clearly illustrate the construction.
Figure 4:
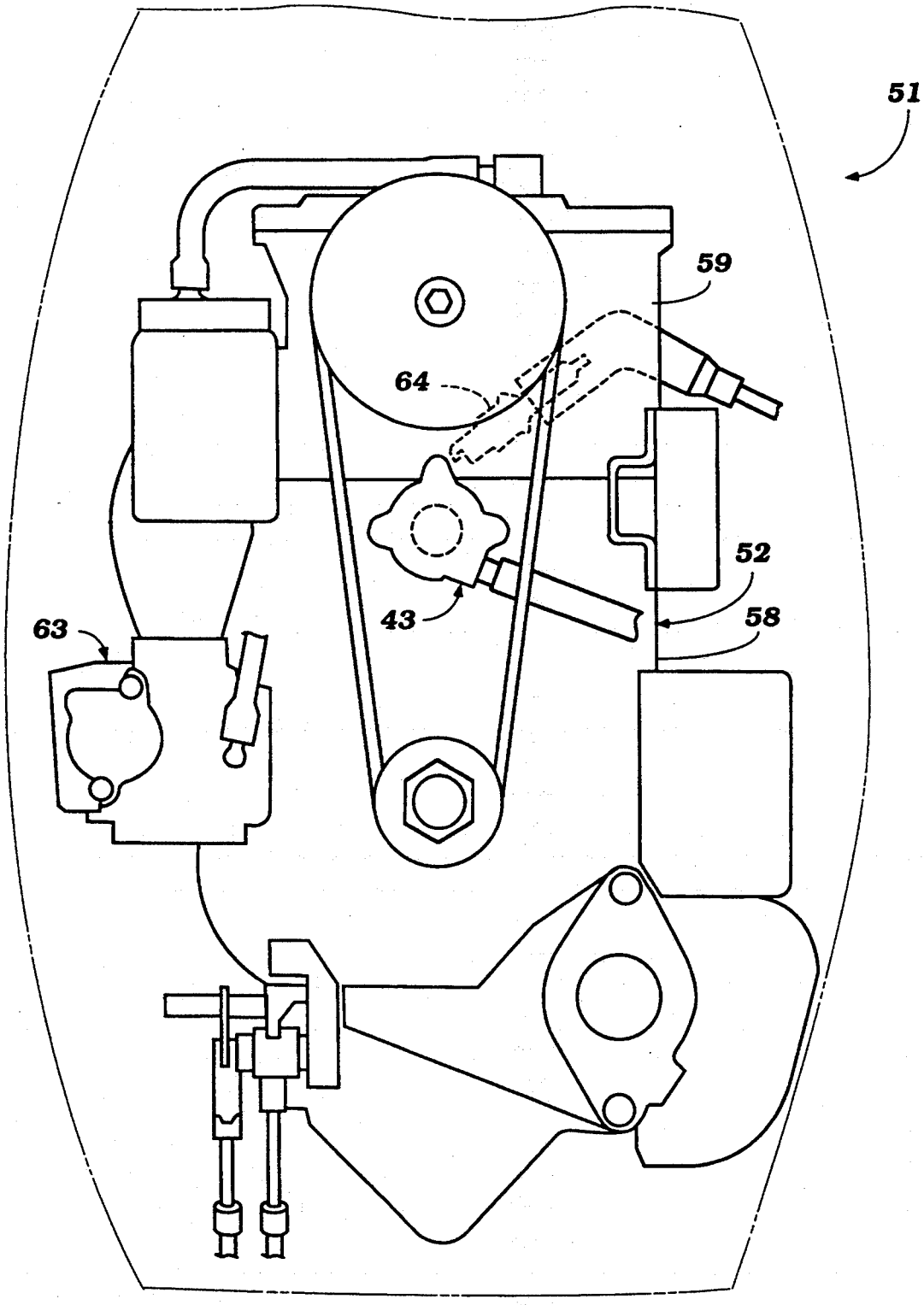
FIG. 4 is a top plan view taken in the direction of the arrow F in FIG. 3 of the elements shown in FIG. 3 with the same elements shown in solid and phantom lines.

Referring now in detail to FIGS. 3–9 and initially primarily to FIGS. 3 and 4, an outboard motor constructed in accordance with a preferred embodiment of the invention is identified generally by the reference numeral 51. Since, as has been discussed above, the invention deals primarily with the cooling arrangement for the oil pan for the engine, many of the figures such as FIGS. 3 and 4 show other components in phantom and none of the figures show the complete outboard motor. Therefore, where the complete outboard motor or any components of it or the engine are not illustrated or described, they may be considered to be conventional. Reference may be had to either the description of FIG. 1 or any prior art descriptions of conventional structures.

In this embodiment, an internal combustion engine of the power head of the outboard motor is identified by the reference numeral 52 and is mounted within the power head on a spacer plate 53 so that its crankshaft 54 rotates about a vertically extending axis. The crankshaft 54 is coupled to a drive shaft 55 which depends into a drive shaft housing 56 which extends beneath the spacer plate 53 and which has a propulsion unit (not shown) at its lower end which is driven by the drive shaft 55 in the manner described. A clamping, swivel bracket assembly 57 is interconnected between the drive shaft housing 56 and the transom of the associated watercraft for mounting of the outboard motor 51 in the manner already described.

The engine 52 is comprised of a cylinder block 58 and an attached cylinder head 59 which define a number of cylinders although the invention may be employed with single cylinder engines. In addition, in the illustrated embodiment, the engine 52 is of the four cycle, overhead cam type and to this end a cam shaft 61 is journaled in the cylinder head 59 and is driven by the crankshaft 54 through a timing belt arrangement, indicated generally by the reference numeral 62. Although the invention is described in conjunction with four cycle engines where it has particular utility, it will be apparent to those skilled in the art that the invention may also be employed with two cycle engines that have separate lubricating systems although those engines do not present the same difficulties as four cycle engines. For that reason, the invention has primary utility in conjunction with four cycle engines.

An induction system, indicated generally by the reference numeral 63 and shown in FIG. 4 is disposed on one side of the engine and supplies a fuel air charge to the cylinders of the engine in a well known and conventional manner. This charge is then fired by spark plugs 64 mounted in the cylinder head 59 and discharged through an exhaust manifold and exhaust system formed, as is typical with outboard motor practice, in the cylinder head 59 and cylinder block 58. These exhaust gases are discharged downwardly into the drive shaft housing 56 through a discharge port that is formed in the lower face of the engine and specifically the cylinder block 58 and which communicates with an exhaust gas discharge opening 65 (FIGS. 6–8) in the spacer plate 53.

Certain remaining components of the exhaust system will be described by reference to later figures but these include an exhaust pipe 66 that is affixed to the underside of the spacer plate 53 in a manner to be described and which discharges into an expansion chamber (not shown) formed in the drive shaft housing 56 for discharge to the atmosphere through a high speed underwater exhaust gas discharge when the watercraft is traveling at higher rates of speed. The exhaust system discharge through an above the water exhaust gas discharge when operating at idle or traveling at low speed. Since these exhaust gas discharges are well known in the art, further descriptions of them are not believed to be necessary although parts of the low speed discharge will be described later.

Referring now to the remaining figures (FIGS. 5–9) in addition to FIG. 3, the engine 52 is provided with a lubricating system that includes an oil tank or reservoir 67 that is affixed to the underside of the spacer plate 53 in a known manner and which includes a peripheral wall 68 that provides a cavity 69 that receives and contains lubricant. This cavity obviously depends completely within the drive shaft housing 56. The oil tank 67 further has an inner wall 70 that defines a cavity 71 that surrounds the upper portion of the exhaust pipe 66 as clearly seen in FIGS. 5 and 6.

The lubricant is drawn from the lubricant reservoir 69 by an engine driven oil pump (not shown) which may be driven off the lower end of the cam shaft 61 through a strainer 72 that is provided at the lower end of a conduit 73. The conduit 73 extends upwardly to a passage 74 formed in the spacer plate 53 and delivers the lubricant to the lubricant pump through internal passageways formed in the cylinder block 58 and cylinder head 59. This lubricant is circulated through any desired path and is then drained back for return to the oil tank cavity 69 through a drain passage 75 (FIG. 7) formed in the spacer plate 53.

Figure 5:
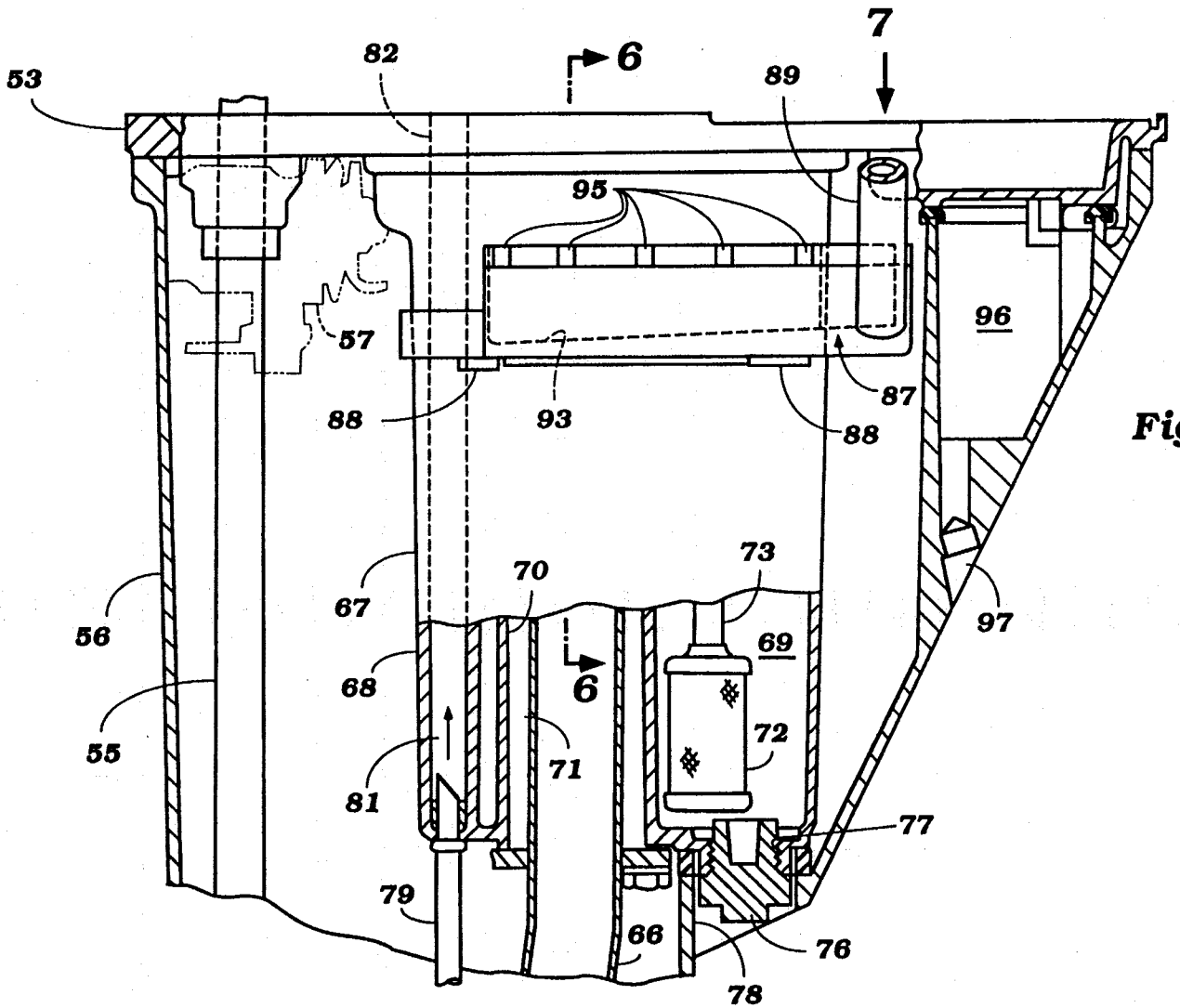
FIG. 5 is a further enlarged side elevational view, in part similar to FIG. 3, and showing components of the oil reservoir broken away and in section.
Figure 6:
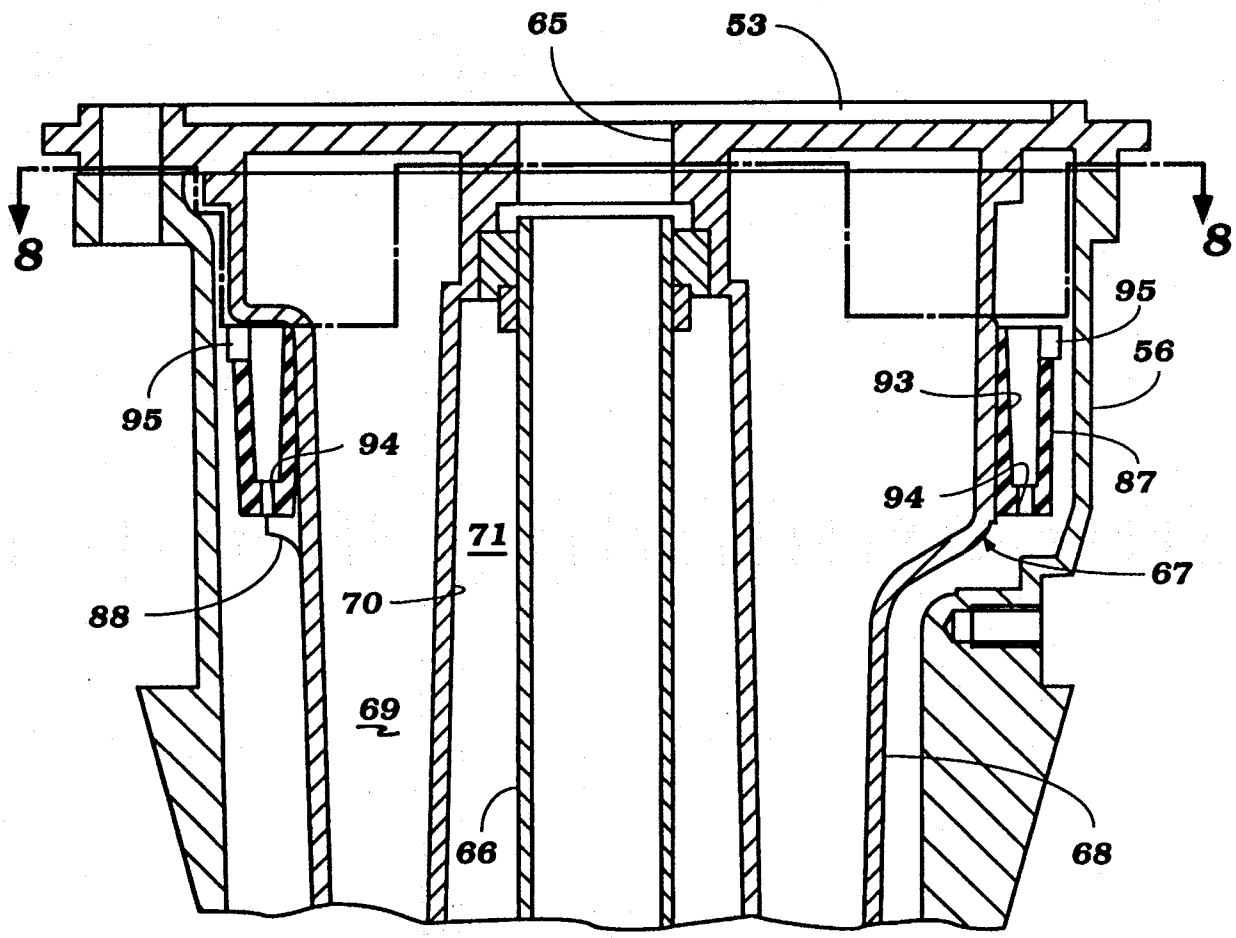
FIG. 6 is a cross-sectional view taken along the line 6—6 of FIGS. 5 and 8.
Figure 7:
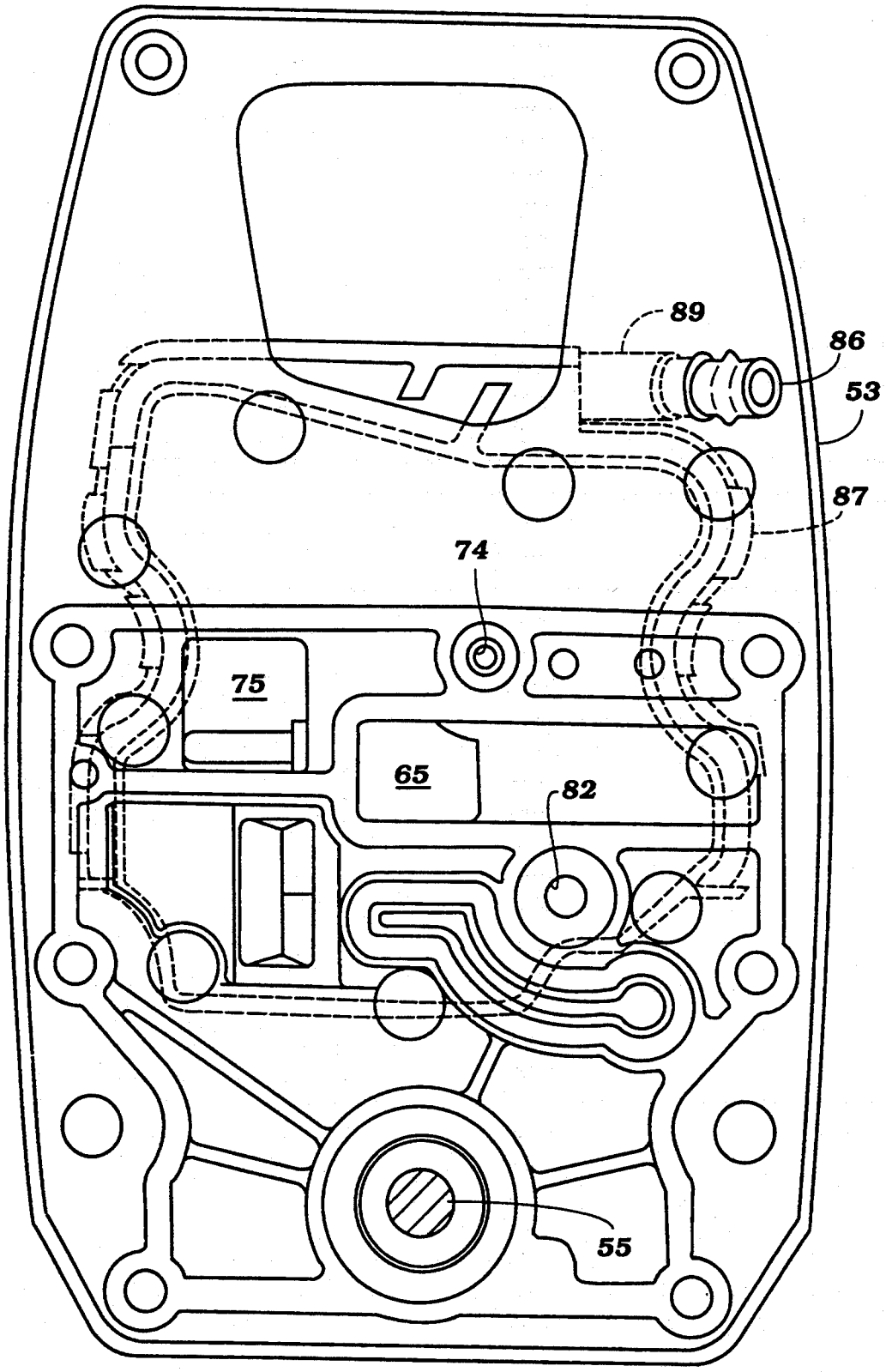
FIG. 7 is a top plan view of the spacer plate looking in the direction of the arrow 7 in FIG. 5.
Figure 8:
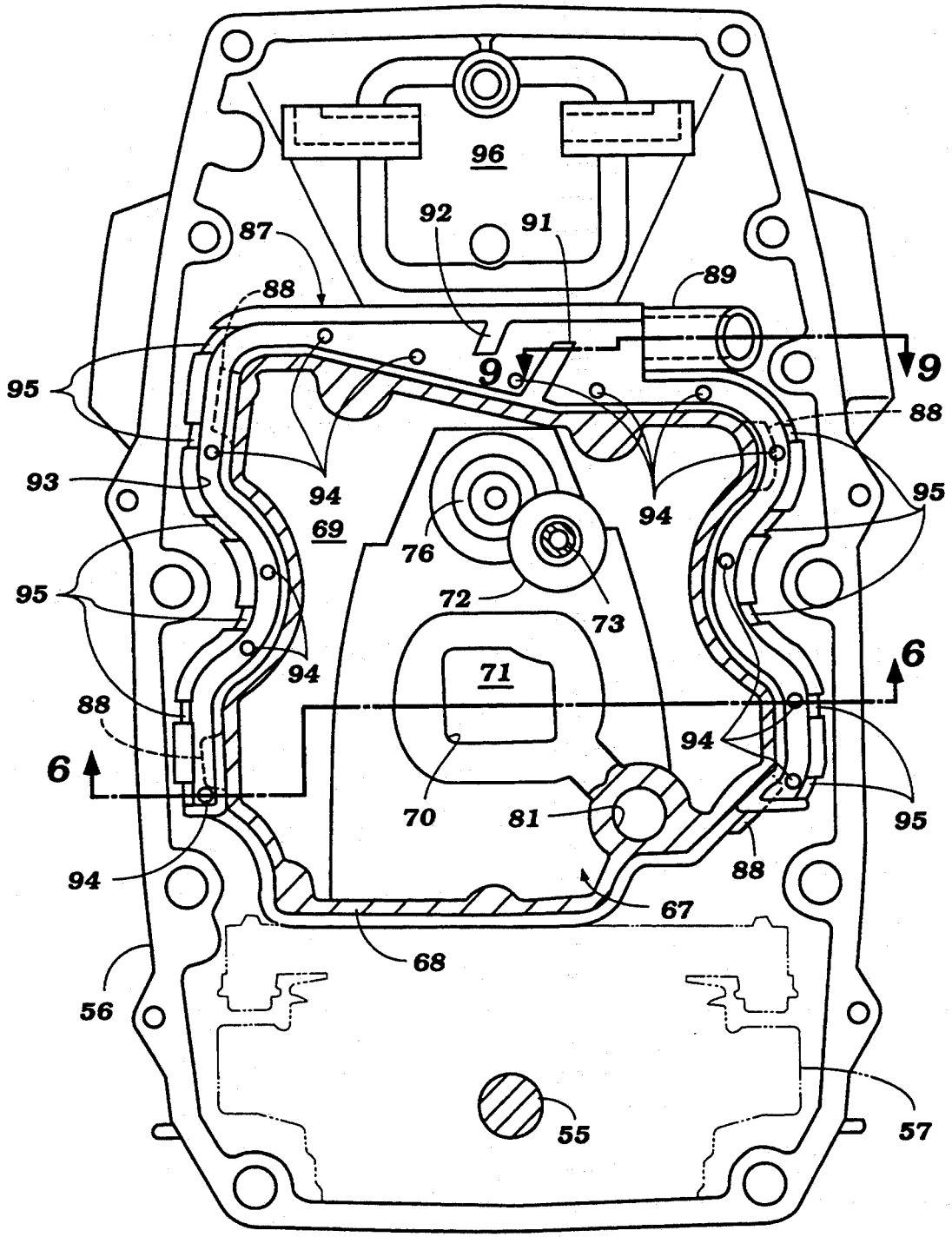
FIG. 8 is a cross-sectional view taken along the line 8—8 of FIG. 6.
Figure 9:
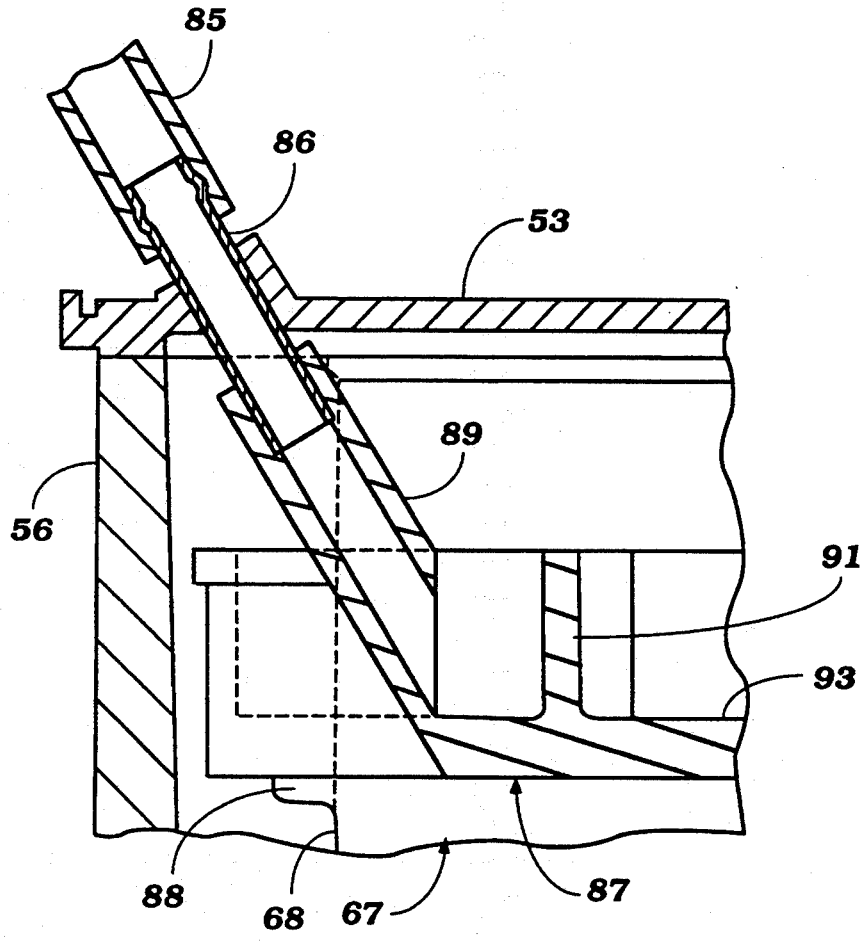
FIG. 9 is an enlarged cross-sectional view taken along the line 9—9 of FIG. 8.

The lubricant in the lubricant reservoir 67 may be drained by means of a drain plug 76 that is threaded into a taped opening 77 formed in the lower wall of the oil pan 67 (FIGS. 5 and 8). This oil plug 76 is accessible through an opening 78 in the drive shaft housing 56.

As has been noted, the engine 52 is water cooled and cooling water is drawn from a water inlet (not shown) in the lower unit by means of a water pump (also not shown) that is driven off the drive shaft 55 at the interface between the drive shaft housing and the lower unit. This water is delivered upwardly through a flexible conduit 79 positioned in the drive shaft housing 56 and which communicates with a cooling passage, jacket 81 that is formed in the outer wall 68 of the oil pan 67. As a result of this coolant flow through the jacket 81, there will be some cooling of the oil in the oil tank 67 and the exterior wall 68. However, this cooling per se is not adequate to sufficiently cool the system in many instances.

The cooling water flows from the cooling jacket 81 through a passage 82 formed in the spacer plate 53 to the cooling jacket of the cylinder block 58 and 59 which may be of any conventional nature and thus are not illustrated. However, the flow of cooling water through the engine cooling jacket is indicated by the arrows 83 in FIG. 3. This coolant is then discharged from the cooling jacket of the cylinder block 58 through a thermostatic housing 84 to a conduit 85. The conduit 85 communicates with a coolant nipple 86 that extends through the spacer plate 53.

In accordance with the invention, a cooling trough, indicated generally by the reference numeral 87 and having a generally open top is mounted in encircling fashion to the oil reservoir 67 and on a plurality of outstanding lugs 88 formed in spaced relationship therearound.

Water is delivered to the cooling trough 87 through an inlet fitting 89 that has a slip connection with the nipple 86. As may be best seen in FIGS. 8 and 9, this water inlet 89 is directed into confronting relationship with a pair of internal baffles 91 and 92 formed adjacent the entry of the inlet pipe 89 to the trough 87. These baffles 91 and 92 serve to direct the water flow through an open ended trough portion 93 that is formed by the trough 87 and which basically encircles at least three sides of the outer wall 68 of the oil pan 67. The baffles ensure that flow will pass in both directions from the generally central inlet of the water inlet 89 to the opposite ends of trough portion 93.

A plurality of spaced openings 94 are formed in the lower wall of the trough portion 93 and in proximity to the outer wall 68 of the oil pan 67 so that the cooling water will flow over substantially the entire outer periphery of the oil pan outer wall 68. Baffles (not shown) may be provided so as to ensure that the water is directed to the outer wall surface 88. Also, due to the depth of the trough 93, the trough will be maintained filled with water even when the watercraft and engine 52 are operating at low speeds or idle.

The upper end of the outer peripheral wall of the trough 87 is provided with a plurality of notches 95 which act as weirs so that if large amounts of water are being discharged by the engine due to its high speed operation, the water will flow over the outer wall through the weirs 95. The weirs 95 are also directed as is the outer shape of the trough 87 so that this overflowing water will also be directed on the oil pan outer surface 68 as shown by the arrows in FIG. 3. Thus, the smaller openings 94 will ensure that a uniform and complete head of water is maintained within the trough portion 93 at low speeds and the weirs 95 will ensure that water blockage will not occur but that the excess water flow will pass over the outer periphery of the oil pan 67 for adequate and complete cooling.

Thus, even though the exhaust gases from the engine pass in close proximity to the oil pan 67 and although the oil pan 67 may in fact be surrounded by or in proximity to an expansion chamber for exhaust silencing, the lubricant for the engine will not become heated and the walls of the oil pan 67 will not be so hot that water will evaporate off of them and leave deposits that could cause corrosion.

As has been previously noted, the exhaust system includes a high speed underwater exhaust gas discharge and a low speed above the water exhaust gas discharge. This above the water exhaust gas discharge is shown partially in FIGS. 5 and 8 and includes an expansion chamber 96 that is formed integrally with the rear wall of the drive shaft housing 56. Exhaust gases are delivered to this expansion chamber 96 through a suitable path which may include additional expansion chambers as well as restrictions therebetween for several expansions and contractions of the exhaust gases for silencing even under above the water discharge conditions. An above the water exhaust gas discharge passage 97 extends from the lower portion of the expansion chamber 96 through the drive shaft housing 56 to the atmosphere. This discharge opening 97 is formed at the lower portion of the expansion chamber 96 so that any water that may become entrained with the exhaust gases will also be drained and will not accumulate in the expansion chamber 96.

It should be readily apparent from the foregoing description that the described embodiment provides very effective cooling of the oil pan and permits its positioning in the drive shaft housing. Of course, the foregoing description is that of the preferred embodiment of the invention and various changes and modifications may be made without departing from the spirit and scope of the invention, as defined by the appended claims.

I claim:

1. An outboard motor comprised of a power head having a powering internal combustion engine, a drive shaft housing and lower unit depending from said power head and containing a propulsion device driven by said engine for propelling an associated watercraft, a lubricant reservoir depending into said drive shaft housing and having an outer wall, a water manifold surrounding said outer wall and having a plurality of spaced discharge openings in the lower portion thereof for directing water toward said outer wall, and means for delivering cooling water to said water manifold.

2. The outboard motor as set forth in claim 1, wherein the water manifold comprises an open top trough and further having a plurality of weir-like openings for permitting flow over the top of the trough, the lower openings being substantially smaller in cross-sectional area than the weir-like openings for maintaining a uniform head of water in the manifold regardless of the engine speed.

3. The outboard motor as set forth in claim 2, wherein the weir-like openings direct the water flowing over the manifold to the outer wall of the lubricant reservoir.

4. The outboard motor as set forth in claim 3, wherein the lower openings cooperate with means for redirecting the water flow to the outer wall of the lubricant reservoir.

5. The outboard motor as set forth in claim 1, wherein the means for delivering water to the manifold delivers water to a central position in the manifold and further including a pair of flow directing baffles for directing water from the water inlet toward opposite ends of said manifold.

6. The outboard motor as set forth in claim 5, wherein the water manifold comprises an open top trough and further having a plurality of weir-like openings for permitting flow over the top of the trough, the lower openings being substantially smaller in cross-sectional area than the weir-like openings for maintaining a uniform head of water in the manifold regardless of the engine speed.

7. The outboard motor as set forth in claim 6, wherein the weir-like openings direct the water flowing over the manifold to the outer wall of the lubricant reservoir.

8. The outboard motor as set forth in claim 7, wherein the lower openings cooperate with means for redirecting the water flow to the outer wall of the lubricant reservoir.

9. The outboard motor as set forth in claim 1, wherein the engine is water cooled and substantially all of the water coolant from the engine is delivered to the manifold.

10. The outboard motor as set forth in claim 9, wherein the water manifold comprises an open top trough and further having a plurality of weir-like openings for permitting flow over the top of the trough, the lower openings being substantially smaller in cross-sectional area than the weir-like openings for maintaining a uniform head of water in the manifold regardless of the engine speed.

11. The outboard motor as set forth in claim 10, wherein the weir-like openings direct the water flowing over the manifold to the outer wall of the lubricant reservoir.

12. The outboard motor as set forth in claim 11, wherein the lower openings cooperate with means for redirecting the water flow to the outer wall of the lubricant reservoir.

13. The outboard motor as set forth in claim 9, wherein the means for delivering water to the manifold delivers water to a central position in the manifold and further including a pair of flow directing baffles for directing water from the water inlet toward opposite ends of said manifold.

14. The outboard motor as set forth in claim 13, wherein the water manifold comprises an open top trough and further having a plurality of weir-like openings for permitting flow over the top of the trough, the lower openings being substantially smaller in cross-sectional area than the weir-like openings for maintaining a uniform head of water in the manifold regardless of the engine speed.

15. The outboard motor as set forth in claim 14, wherein the weir-like openings direct the water flowing over the manifold to the outer wall of the lubricant reservoir.

16. The outboard motor as set forth in claim 15, wherein the lower openings cooperate with means for redirecting the water flow to the outer wall of the lubricant reservoir.

17. The outboard motor as set forth in claim 1, wherein the engine is a four cycle internal combustion engine and is mounted on the upper side of a spacer plate positioned at the upper end of the drive shaft housing and the lubricant reservoir is mounted on the underside of the spacer plate.

18. The outboard motor as set forth in claim 17, wherein the engine has an exhaust gas discharge that communicates with an exhaust pipe for discharging the exhaust gases to the drive shaft housing.

19. The outboard motor as set forth in claim 18, wherein the exhaust pipe passes at least in part through a cavity formed in the lubricant reservoir.

20. The outboard motor as set forth in claim 19, wherein the coolant for the manifold is delivered by a pump positioned at the lower end of the drive shaft housing and lower unit and which delivers water to the manifold through an internal cooling jacket formed in the outer wall of the lubricant reservoir.

* * * * *